US010898044B2

(12) United States Patent
Grey et al.

(10) Patent No.: US 10,898,044 B2
(45) Date of Patent: Jan. 26, 2021

(54) DIRT-COLLECTION CHAMBER AND SUCTION HEAD FOR A VACUUM CLEANER

(71) Applicant: GREY TECHNOLOGY LIMITED, Warndon (GB)

(72) Inventors: Nicholas Gerald Grey, Warndon (GB); Matthew James Isted, Warndon (GB); Andrew John Kent, Warndon (GB)

( * ) Notice: Subject to any disclaimer, the term of this patent is extended or adjusted under 35 U.S.C. 154(b) by 173 days.

(21) Appl. No.: 16/077,997

(22) PCT Filed: Feb. 27, 2017

(86) PCT No.: PCT/GB2017/050509

§ 371 (c)(1),
(2) Date: Aug. 14, 2018

(87) PCT Pub. No.: WO2017/144918

PCT Pub. Date: Aug. 31, 2017

(65) Prior Publication Data

US 2020/0046188 A1 Feb. 13, 2020

(30) Foreign Application Priority Data

Feb. 25, 2016 (GB) ..... 1603302.9

(51) Int. Cl.
*A47L 9/14* (2006.01)
*A47L 9/04* (2006.01)

(52) U.S. Cl.
CPC ..... *A47L 9/1409* (2013.01); *A47L 9/0466* (2013.01)

(58) Field of Classification Search
CPC ..... A47L 5/30; A47L 9/0466; A47L 9/1409; A47L 9/1463; A47L 9/149; A47L 9/20
See application file for complete search history.

(56) References Cited

U.S. PATENT DOCUMENTS 1,508,315 A 9/1924 Brockway
2,867,833 A 1/1959 Duff
(Continued)

FOREIGN PATENT DOCUMENTS

DE 102015116074 A1 3/2016
EP 1136029 A2 9/2001
(Continued)

OTHER PUBLICATIONS

PCT International Search Report, PCT/GB2017/052867, Applicant: Grey Technology Limited, dated Feb. 1, 2018.
(Continued)

*Primary Examiner* — Marc Carlson
(74) *Attorney, Agent, or Firm* — Pedersen & Company, PLLC; Ken J. Pedersen; Barbara S. Pedersen

(57) ABSTRACT

This invention relates to a dirt-collection chamber (10) for a vacuum cleaner, and in particular a dirt-collection chamber (10) which is removable whereby the collected dirt can easily be disposed of. The dirt-collection chamber (10) has an air inlet (22) and an air outlet (62), a filter (60) between the air inlet (22) and the air outlet (62), and a disposal opening with an openable cover (16). The dirt-collection chamber (10) has a dirt-removal panel (40) in the chamber which is movable towards and away from the disposal opening to assist in the disposal of collected dirt and debris.

27 Claims, 8 Drawing Sheets

(56) References Cited

U.S. PATENT DOCUMENTS 4,905,342 A 3/1990 Ataka
4,924,548 A 5/1990 Touya et al.
5,271,751 A 12/1993 Lägler
5,590,439 A 1/1997 Alazet
6,009,594 A 1/2000 Grey
6,055,701 A 5/2000 Grey et al.
6,101,668 A 8/2000 Grey
6,243,912 B1 6/2001 Grey
6,625,845 B2 * 9/2003 Matsumoto ..... A47L 9/108 15/352
6,949,130 B1 9/2005 Grey et al.
6,968,587 B2 11/2005 Grey
7,013,521 B2 3/2006 Grey
7,017,221 B1 3/2006 Grey et al.
7,117,556 B2 10/2006 Grey
7,152,276 B2 * 12/2006 Jin ..... A47L 9/1675 15/352
D554,814 S 11/2007 Grey
7,331,078 B2 2/2008 Grey
7,334,284 B2 2/2008 Grey
D568,008 S 4/2008 Grey
7,802,343 B2 9/2010 Grey
D694,481 S 11/2013 Grey et al.
9,560,944 B2 * 2/2017 Grey ..... A47L 9/325
9,737,183 B2 8/2017 Grey
9,943,199 B2 8/2018 Grey et al.
2001/0025395 A1 * 10/2001 Matsumoto ..... A47L 9/20 15/353
2002/0148070 A1 * 10/2002 Tsuchiya ..... A47L 9/325 15/352
2003/0159235 A1 * 8/2003 Oh ..... A47L 9/1666 15/352
2003/0159236 A1 * 8/2003 Oh ..... A47L 9/20 15/352
2003/0159237 A1 * 8/2003 Oh ..... A47L 9/20 15/352
2004/0074027 A1 4/2004 Grey
2005/0138764 A1 6/2005 Grey
2005/0198766 A1 * 9/2005 Nam ..... B01D 46/0075 15/352
2005/0198771 A1 * 9/2005 Min ..... A47L 5/362 15/353
2005/0204492 A1 9/2005 Grey
2005/0217067 A1 * 10/2005 Rew ..... A47L 9/20 15/352
2006/0000040 A1 1/2006 Grey et al.
2006/0123749 A1 6/2006 Park
2007/0022563 A1 2/2007 Wu
2008/0022485 A1 1/2008 Grey
2009/0300873 A1 12/2009 Grey
2011/0277269 A1 * 11/2011 Kim ..... A47L 11/33 15/349
2011/0308038 A1 * 12/2011 Rowntree ..... A47L 5/24 15/347
2014/0033473 A1 2/2014 McVey
2014/0237761 A1 * 8/2014 Holz ..... A47L 9/1683 15/347
2016/0088987 A1 3/2016 Hwang et al.
2016/0174802 A1 * 6/2016 Conrad ..... A47L 9/1683 15/329
2016/0287042 A1 * 10/2016 Han ..... A47L 9/1683
2018/0310788 A1 * 11/2018 Han ..... A47L 9/20
2019/0029482 A1 1/2019 Grey et al.
2020/0046188 A1 * 2/2020 Grey ..... A47L 5/30

FOREIGN PATENT DOCUMENTS

EP 1955631 A1 8/2008
EP 1980188 A2 10/2008
GB 2427351 A 12/2006
GB 2535836 A 8/2016
JP H08228975 A 9/1996
JP H11239551 A 9/1999
JP 2011120956 A 6/2011
WO 2005/053496 A1 6/2005
WO 2012/085567 A1 6/2012
WO 2017/144918 A1 8/2017
WO 2017/144922 A1 8/2017

OTHER PUBLICATIONS

PCT International Preliminary Report on Patentability, PCT/GB2017/052867, Applicant: Grey Technology Limited, Date of completion: Oct. 1, 2018.
Examination Report No. 1 for Application No. 2017224948, Applicant: Grey Technology Limited, dated Jul. 30, 2019, IP Australia.
PCT International Search Report, PCT/GB2017/050509, dated Jun. 21, 2017, Applicant: Grey Technology Limited.
PCT International Search Report, PCT/GB2017/050528, dated Jul. 31, 2017, Applicant: Grey Technology Limited.
UK Examination Report of Applicant's corresponding application in UK, GB1812103.8, dated Jun. 26, 2020.

* cited by examiner

DIRT-COLLECTION CHAMBER AND SUCTION HEAD FOR A VACUUM CLEANER

FIELD OF THE INVENTION

This invention relates to a dirt-collection chamber and suction head for a vacuum cleaner, and in particular a dirt-collection chamber which is removable whereby the collected dirt can easily be disposed of.

BACKGROUND TO THE INVENTION

Vacuum cleaners have a motor which typically drives an impeller to create a flow of air. The suction head of the vacuum cleaner has an opening in its bottom wall through which air can enter, the air carrying dirt and debris into the suction head.

It is arranged that the air transports the dirt and debris by way of one or more airflow ducts within the suction head. The dirt and debris is transported through the duct(s) to a dirt-collection chamber. The air then passes through one or more filters before leaving the vacuum cleaner, the filters being arranged to trap the dirt and debris within the dirt-collection chamber for subsequent disposal.

The dirt-collection chamber can contain or comprise a disposable bag, the wall of the bag also acting as a filter. Alternatively, the dirt-collection chamber is a receptacle which can be removed from the vacuum cleaner, emptied, and re-installed into the vacuum cleaner for re-use. The present invention relates to this alternative type of dirt-collection chamber.

Many vacuum cleaners are mains powered. Most domestic mains-powered vacuum cleaners fall into two broad classes. The first class is often referred to as cylinder vacuum cleaners. In cylinder vacuum cleaners the suction head is connected to an operating handle which in turn is connected to a flexible hose through which the dirt and debris pass on their way to the dirt-collection chamber. The dirt-collection chamber is located within a body which is separate from the suction head and which also contains the motor, the body usually having wheels or slides by which it may be pulled across the floor during the cleaning operation.

The second class is often referred to as upright vacuum cleaners. In upright vacuum cleaners the motor and dirt-collection chamber are carried by, or in some cases are integral with, the operating handle, so that the body containing the motor and the dirt-collection chamber typically lie above the suction head during the cleaning operation.

Battery-powered vacuum cleaners are also known, and may adopt a somewhat different approach with the battery, motor, impeller and dirt-collection chamber all located in the suction head. The operating handle connected to the suction head is therefore used solely for manoeuvring the suction head across the floor being cleaned. A battery-powered vacuum cleaner is described in our patent application WO 2012/085567.

The vacuum cleaner of WO 2012/085567 has a dirt-collection chamber which can be removed from the suction head and transported to a bin or the like where the collected dirt and debris is disposed of. The filter is located within the cover or lid of the dirt-collection chamber and is removed with the dirt-collection chamber. The lid including the filter can be opened at the disposal site to allow the chamber to be emptied.

Cyclonic dirt-collection chambers are known. They often have an outer cavity for fibrous dirt and an inner cavity for fine dirt and dust. The air and fine dirt and dust passes from the outer cavity to the inner cavity by way of a perforated shroud. The lid of a cyclonic dirt-collection chamber can be at an end of the chamber and it is often possible to position that end of the chamber into the mouth of a larger receptacle such as a kitchen bin or the like before the lid is opened, whereby to seek to minimise the likelihood that any of the collected dirt and debris will be spilled.

A first known (and common) problem with cyclonic dirt-collection chambers is that dirt and debris becomes trapped between the perforated shroud and the wall(s) of the outer cavity. It is not uncommon for the user to have to break up compressed dirt and debris in order to release it from the outer cavity and it is not desirable for the user to use his or her fingers to pull out trapped debris.

A second known (and also common) problem with cyclonic dirt-collection chambers results from the separation of the fine dust from the fibrous debris. On emptying into a receptacle such as a kitchen bin, the denser fine dust typically falls into the receptacle first. At least some of the fine dust will become airborne, and care needs to be taken to seek to ensure that the airborne dust remains within the receptacle. Even so, however, when the fibrous debris subsequently falls into the receptacle it displaces at least some of the airborne dust and causes it to escape from the receptacle into the surrounding environment, which is clearly undesirable. If, as is common, the user has to shake the dirt-collection chamber to release the fibrous debris from the outer cavity, the likelihood of airborne dust escaping the receptacle can be exacerbated.

A third known problem with cyclonic dirt-collection chambers is their space efficiency. As the fibrous debris spins around the outer cavity it becomes relatively aerated. In addition, if the collected dirt fills too much of the chamber it will block the perforations in the shroud and become even harder to remove. In order to minimise this problem, manufacturers provide transparent dirt-collection chambers and provide a "max. fill" marking which the user is expected to observe, and to empty the chamber when the collected dirt reaches that level. It is often remarkable how little dirt is collected in even large cyclonic dirt-collection chambers before the "max. fill" level is reached.

One of the design intentions of WO 2012/085567 is to utilise the airflow to compress the dust and debris into "bales" in the dirt-collection chamber and to make the bales easy to remove when the lid of the dirt-collection chamber is opened. Because the fibrous debris and fine dust are combined in the bales the likelihood of airborne dust being created during emptying is significantly reduced.

The production embodiments are particularly successful in achieving these aims, but the user is nevertheless somewhat exposed to the dirt while emptying. Also, the production embodiments have a relatively large lid and a correspondingly large opening through which the bales are emptied; the receptacle into which the chamber is emptied must therefore have a reasonably large mouth into which the dirt-collection chamber can be positioned during emptying.

A common problem with vacuum cleaners in general is that the ducts which carry the dirt from the suction opening to the dirt-collection chamber can become blocked by debris. The inventors of WO 2012/085567 successfully overcame this problem by locating the dirt-collection chamber very close to the rotating brush bar and utilising a full-width duct instead of a traditional long, narrow, duct as used by other vacuum cleaner manufacturers.

In production embodiments of WO 2012/085567 the filter can be removed for periodic cleaning. The filter is a two-stage filter providing successive filtering stages and must be oriented correctly upon replacement. Some users fail to orient and/or seat the filter correctly and as a result the performance of the vacuum cleaner is diminished.

US 2002/0148070 also discloses a battery-powered vacuum cleaner having a removable dirt-collection chamber.

Despite the commercial success of production embodiments of WO 2012/085567, the inventors have realised that the periodic emptying of the dirt-collection chamber is not always easy to achieve, and can result in the spillage of dirt by less-diligent users. Also, without due care smaller particles of dust can be dispersed into the air.

The inventors have therefore sought to provide an improved dirt-collection chamber which addresses some of the problems encountered by users of the known products. Whilst the invention has particular utility for a battery-powered vacuum cleaner it is not limited to such use.

SUMMARY OF THE INVENTION

According to the invention there is provided a dirt-collection chamber for a vacuum cleaner, the dirt-collection chamber having an inlet opening through which air may enter the chamber and an outlet opening through which air may leave the chamber, the dirt-collection chamber having a filter between the inlet opening and the outlet opening, the dirt-collection chamber having a disposal opening with an openable cover, characterised in that the dirt-collection chamber has a dirt-removal panel which is movable towards and away from the disposal opening.

Preferably, the inlet opening is a slot running substantially the full length of the dirt-collection chamber.

When it is desired to empty the dirt-collection chamber the user removes the dirt-collection chamber from the vacuum cleaner, opens the disposal opening and then moves the dirt-removal panel towards the disposal opening whereby to push the collected dirt and debris through the disposal opening and out of the chamber. The dirt-removal panel thereby allows the user to force even highly compressed dirt and debris out of the chamber. This avoids the user having to break up the collected dirt and debris, either manually or by way of a suitable tool.

Preferably the inlet opening continues into the disposal opening (and desirably the disposal opening is connected to an end of the inlet opening) so that during emptying the dirt-removal panel can clear any collected debris along and out of the end of the inlet opening to help ensure that the duct does not become blocked.

Preferably, the dirt-collection chamber is tubular with a first end and a second end, and with the openable cover at its second end. The dirt-removal panel is preferably movable between a first position adjacent to the first end and a second position adjacent to the second end.

Desirably, the dirt-collection chamber can only be installed into the suction head if the dirt-removal panel is located in its first position, so that in use it is not possible for dirt and debris to collect "behind" the dirt-removal panel.

Preferably, the dirt-removal panel is mounted upon a rail, the rail extending from close to the first end to close to the second end. Such a rail allows the dirt-removal panel to be moved along the full length of the chamber so as to minimise the chance that any collected dirt and debris remains within the chamber upon disposal.

Desirably, the inlet opening extends from adjacent to the first end to adjacent to the second end. In common with the dirt-collection chambers of the prior art documents, the dirt-collection chamber of the present invention is configured to be oriented across the suction head, close to the rotatable brush. When installed into a suction head the first and second ends of the dirt-collection chamber lie adjacent to the opposed sides of the suction head with the inlet opening directed to the front of the suction head. The dirt-collection chamber ideally spans substantially the full width of the suction head and the inlet opening similarly spans substantially the full width of the suction head. The present invention can therefore share the benefit of a full-width inlet opening is set out in WO 2012/085567.

Desirably, the rail is located adjacent to the inlet opening. This enables the dirt-removal panel inside the chamber to be supported and further allows the dirt-removal panel to be connected to an actuating handle outside the chamber. The user can therefore use the actuating handle (outside the chamber) to drive the dirt-removal panel between its first and second positions without requiring the user to insert his or her fingers into the dirt-collection chamber. The likelihood of the user's fingers becoming dirty is thereby reduced.

Preferably there is an offset between the actuator and the dirt-removal panel so that at the end of its travel the dirt-removal panel protrudes from the end of the bin so that the likelihood of dirt and debris being inadvertently retained in the chamber is reduced or eliminated, and in particular so that fibrous debris can readily fall away.

Preferably, the outlet opening is located at the first end of the dirt-collection chamber. Preferably also, the filter is removable by way of the first end. It will be understood that dirt and dust can accumulate adjacent to the disposal opening during disposal of the collected dirt and debris. The outside of the dirt-collection chamber adjacent to the second end can therefore become dirty over time. The first end of the dirt-collection chamber will therefore be the "clean end" and it is a highly desirable feature that the filter is removed for periodic cleaning by way of the first end. During removal and replacement of the filter the user is therefore less likely to become dirty, with the result that the filter is likely to be cleaned more often and the performance of the vacuum cleaner maximised.

Desirably, the filter is cylindrical and is mounted around a perforated cylindrical mandrel. The mandrel provides structural support to the filter and avoids any requirement for the filter to be rigid or otherwise self-supporting. The filter can therefore be flexible which facilitates removal, cleaning and replacement.

Preferably the mandrel forms part of the exterior of the first "clean" end and provides a clean grip area to enable the user to pull out the filter, tap clean if necessary and replace it into the chamber without getting their fingers dirty.

Preferably the filter is in the form of a "sock" which can be fitted over the mandrel.

Preferably the dirt-collection chamber is substantially cylindrical with the filter located towards the middle of the cylinder. The filter can be surrounded by a perforated wall or shroud which provides a first (coarse) filtration stage. The perforations can be located in selected parts of the shroud to help determine the airflow within the dirt-collection chamber.

Desirably there is a baffle adjacent to the inlet opening. Ideally the baffle spans the full length of the dirt-collection chamber, and also spans the distance between the outer wall and the shroud. The baffle also helps to control the airflow within the dirt-collection chamber, and in particular causes the air to flow around the shroud along a curved path.

The baffle arrangement ensures that, rather than the collected dirt spinning around inside the cylindrical chamber, it collects and compacts into layers thereby increasing the volume of dirt and debris which can be collected in the bin as compared to known cyclonic dirt-collection chambers.

Preferably, at least a part of the dirt-removal panel lies within the inlet opening, the dirt-removal panel moving along the inlet opening during movement of the dirt-removal panel. The dirt-removal panel can engage both of the longitudinal edges of the inlet opening and can wipe and clean those edges each time the chamber is emptied. The full volume of the dirt-collection chamber can therefore be used without fear of blocking the inlet opening, which can avoid the requirement for a "max. fill" line. Instead, the outer wall of the dirt-collection chamber is desirably made of a transparent material so that the user can easily see when it needs to be emptied.

BRIEF DESCRIPTION OF THE PREFERRED EMBODIMENTS

The invention will now be described in more detail, by way of example, with reference to the accompanying drawings, in which.

DETAILED DESCRIPTION

Figure 1:
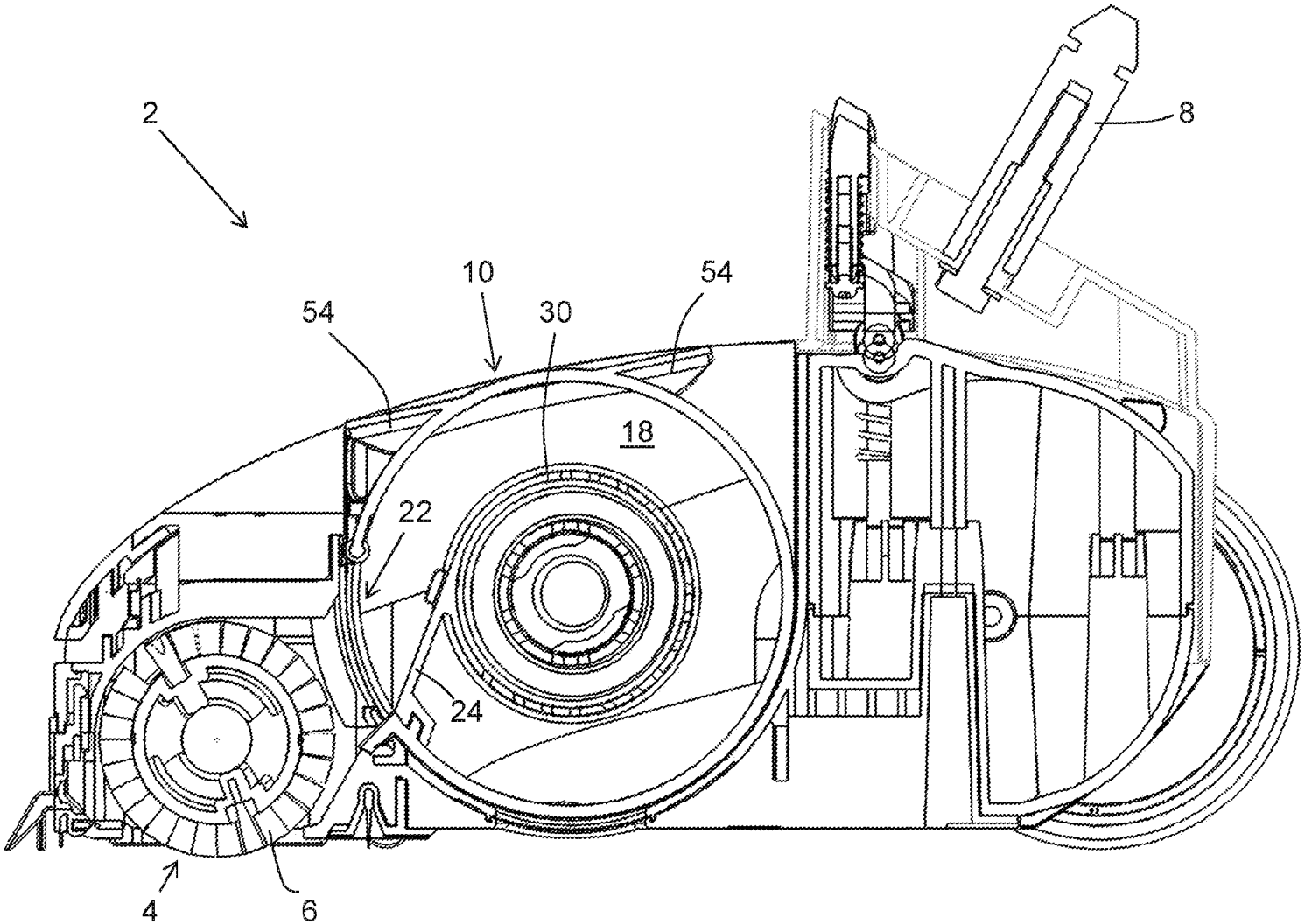
FIG. 1 shows a cross-section of a suction head of a vacuum cleaner fitted with a dirt-collection chamber according to the present invention.

FIG. 1 shows a longitudinal cross-section of the suction head 2 of a battery-powered vacuum cleaner. In common with the vacuum cleaner described in WO 2012/085567, the suction head 2 contains the battery, motor and impeller, none of which are visible in this drawing. The suction head 2 has a suction opening 4 and a rotatable brush 6 protrudes through the suction opening. An operating handle can be connected to the spigot 8 for maneuvering the suction head across the floor being cleaned.

The dirt-collection chamber 10 is located adjacent to the rotatable brush, and is described in more detail in relation to the following drawings. Whilst the dirt-collection chamber 10 is described for the suction head of a battery-powered vacuum cleaner, it will be understood that it is not limited to such applications.

Figure 2:
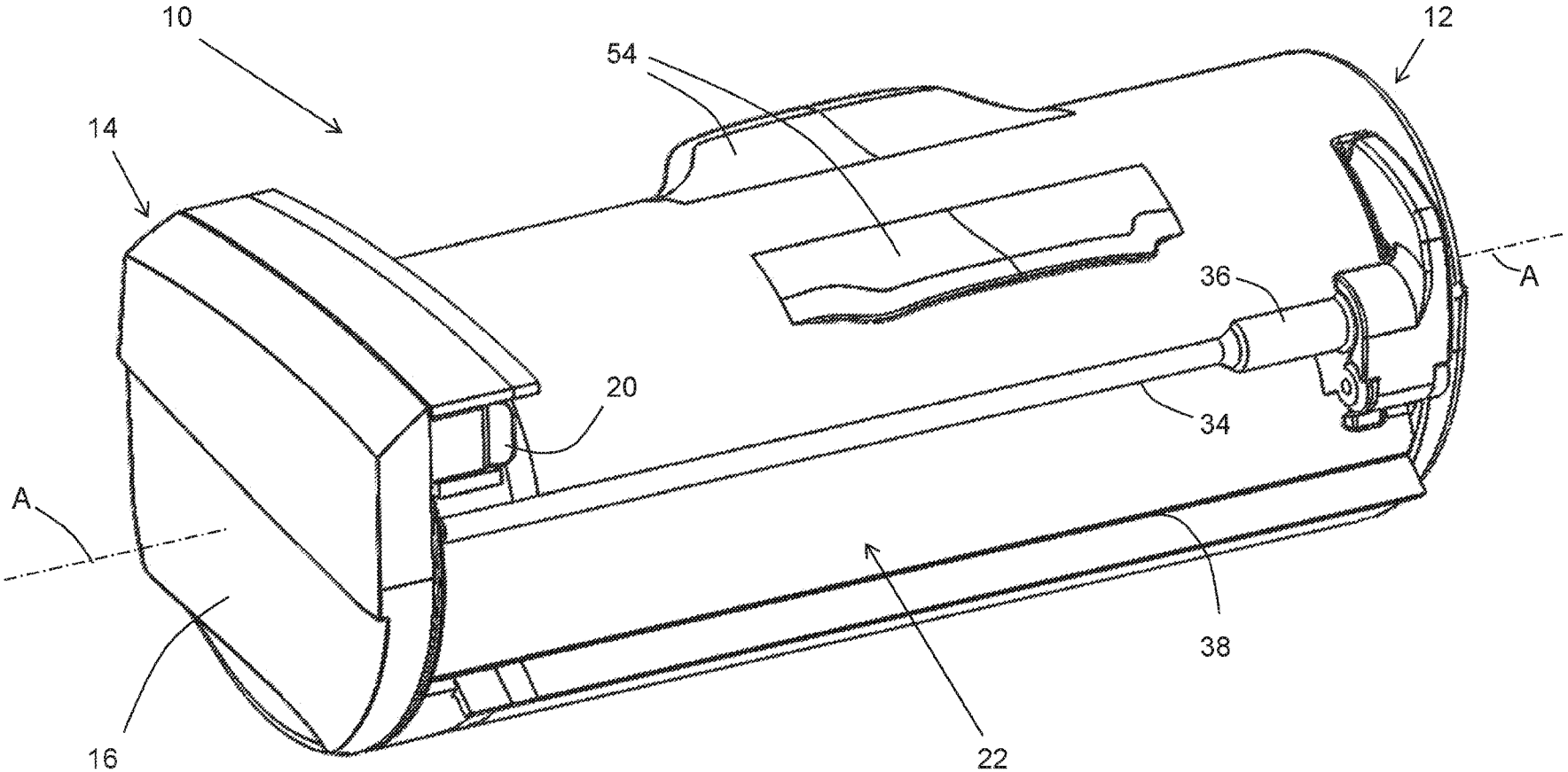
FIG. 2 shows a perspective view of the dirt-collection chamber of the present invention, in the condition of use.

The dirt-collection chamber 10 is designed for removable fitment into a recess of the suction head 2, so that the dirt-collection chamber can be separated from the remainder of the suction head for emptying and/or cleaning. As seen in FIG. 2, the dirt-collection chamber 10 is substantially tubular and cylindrical, with a first end 12 and a second end 14 which are located adjacent to the opposed sides of the suction head 2. The longitudinal axis A-A of the dirt-collection chamber is substantially perpendicular to the plane of the cross-section shown in FIG. 1, and parallel to (or approximately parallel to) the rotational axis of the rotatable brush 6.

In some embodiments the recess in the suction head 2 is open-sided adjacent to the second end 14, so that the second end 14 forms a part of the side surface of the suction head 2.

Figure 4:
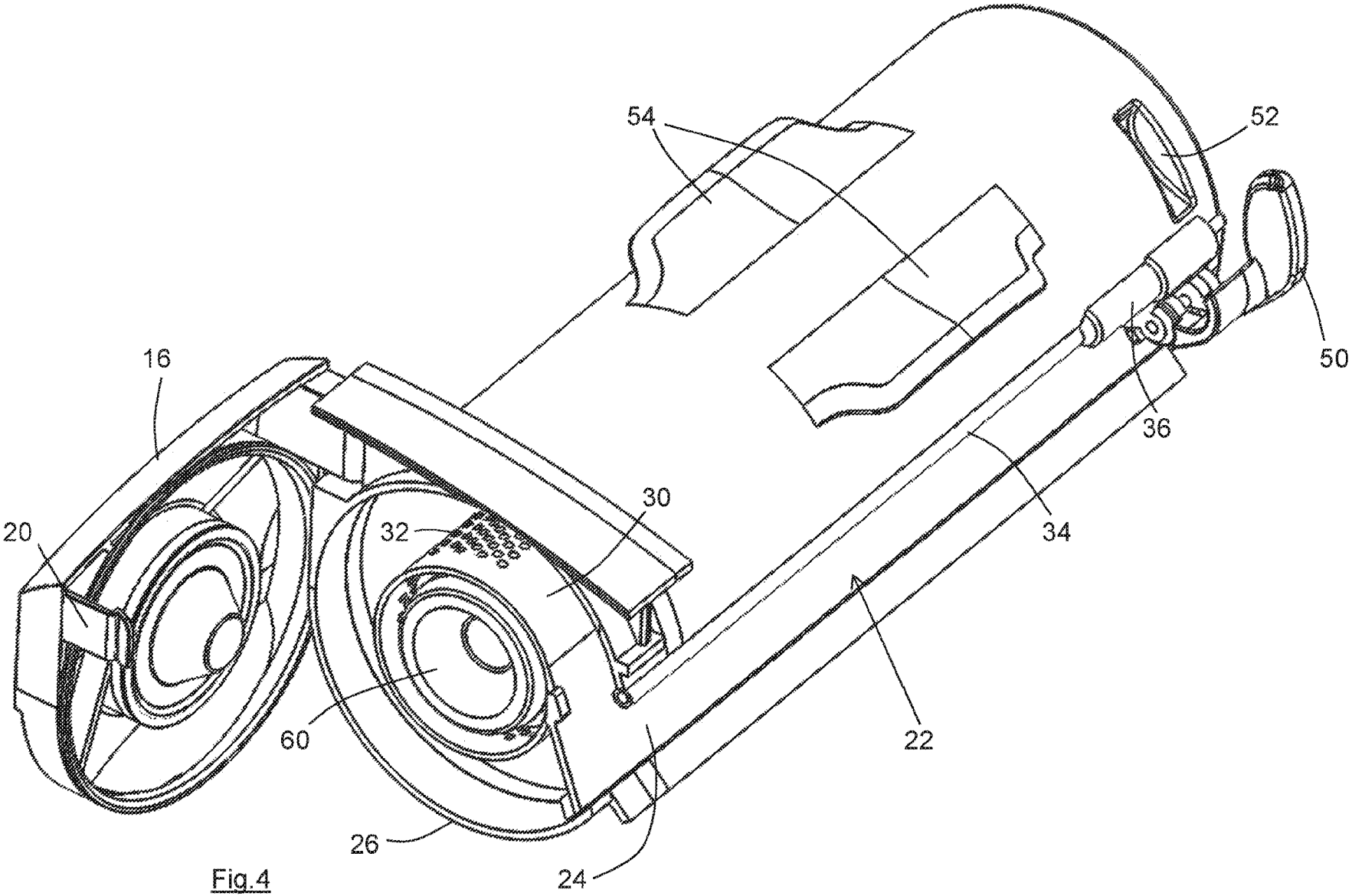
FIG. 4 shows a perspective view of the dirt-collection chamber with the cover opened.

The second end 14 of the dirt-collection chamber has a cover or lid 16 which can be opened as shown in FIG. 4 to expose the disposal opening of the dirt-collection chamber. A latch mechanism 20 secures the cover in the closed position and in known fashion it is arranged that the latch mechanism 20 cannot be released when the dirt-collection chamber is located within its recess in the suction head 2 so as to avoid the inadvertent opening of the chamber.

The dirt-collection chamber 10 has an inlet opening 22. As seen in FIG. 1, the inlet opening 22 lies very close to the rotatable brush 6 with only a short airflow duct therebetween through which dirt and debris pass on their way into the dirt-collection chamber 10.

In the particular embodiment of FIG. 1 the distance between the periphery of the rotatable brush and the inlet opening 22 at its nearest point is between one third and one half of the diameter of the rotatable brush. Also, the distance between the suction opening 4 and the inlet opening at its nearest point is less than the diameter of the rotatable brush. The present invention can therefore share the benefit of WO 2012/085567 in utilising a very short airflow duct upstream of the dirt-collection chamber, which provides the benefits set out in WO 2012/085567, including minimising pumping losses and reducing the likelihood of blockages in the airflow duct.

The inlet opening 22 is in the form of a slot which extends substantially from the first end 12 to the second end 14. The inlet opening 22 is therefore approximately the same length as the rotatable brush 6. The airflow duct between the rotatable brush 6 and the inlet opening 22 is similarly dimensioned and also spans approximately the full length of the rotatable brush. The dirt-collection chamber therefore provides a full-width inlet opening and the suction head has a full-width airflow duct, and share the benefits which that also provides as set out in WO 2012/085567.

As shown most clearly in FIG. 4, a baffle 24 lies adjacent to the inlet opening 22 and spans the outer cavity 18 of the dirt-collection chamber 10, i.e. it spans the distance between the outer wall 26 of the dirt-collection chamber 10 and a shroud within the dirt-collection chamber. As better seen in FIG. 1, the baffle 24 prevents the flow of air downwardly after entry into the dirt-collection chamber 10, and instead causes the inflowing air (and entrained dirt and debris) to flow around the outer cavity 18 in a clockwise direction as viewed in FIG. 1.

In known fashion, a large proportion of the shroud 30 is perforated, the large number of holes 32 formed through the shroud 30 acting as a coarse first stage filter. The provision of a baffle 24 spanning the outer cavity 18 causes fibrous debris such as fluff and hair to pass around the shroud 30 and to become compressed adjacent to the rear surface of the baffle 24 (i.e. the right-hand surface as seen in FIG. 1). The fibrous debris slowly build up around the shroud 30 as the outer cavity 18 is filled. The curved path of the air within the outer cavity 18 causes the majority of the entrained dirt and dust to be carried around the outer cavity 18 and deposited within the mass of fibrous debris. The air leaves the outer cavity 18 through the holes 32 carrying only a small proportion of the incoming dirt and debris, that dirt and debris being separated by a filter located within the shroud 30, as explained below.

The lip of the outer wall 26 which defines the top edge of the inlet opening 22 is formed into a rail 34, which is largely of circular cross-section. The rail carries a slider 36, the slider being configured to slide along the rail between the first end 12 (see FIG. 4) and the second end 14 (see FIG. 5).

Figure 5:
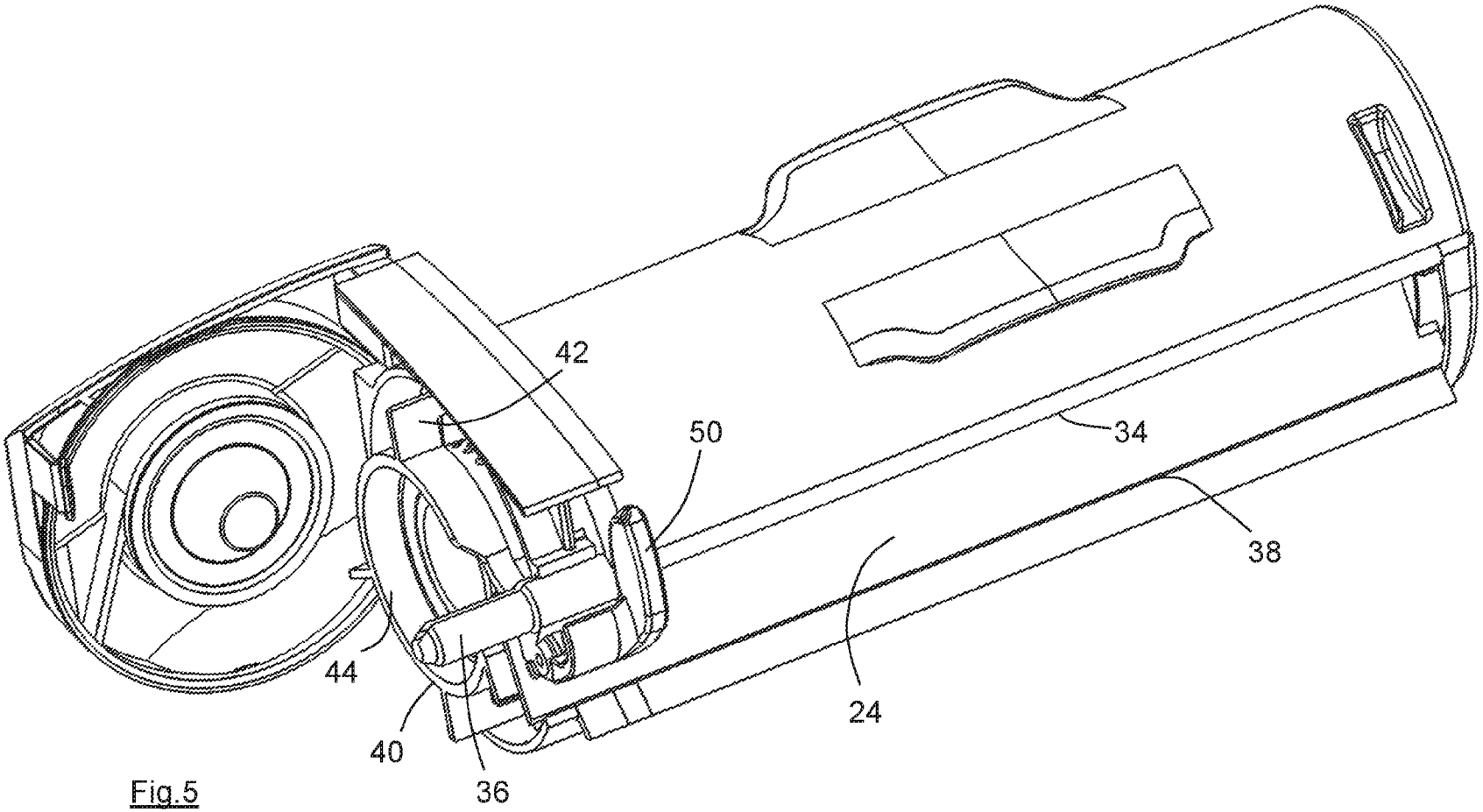
FIG. 5 shows a perspective view of the dirt-collection chamber with the dirt-removal panel moved to the second end of the chamber.
Figure 6:
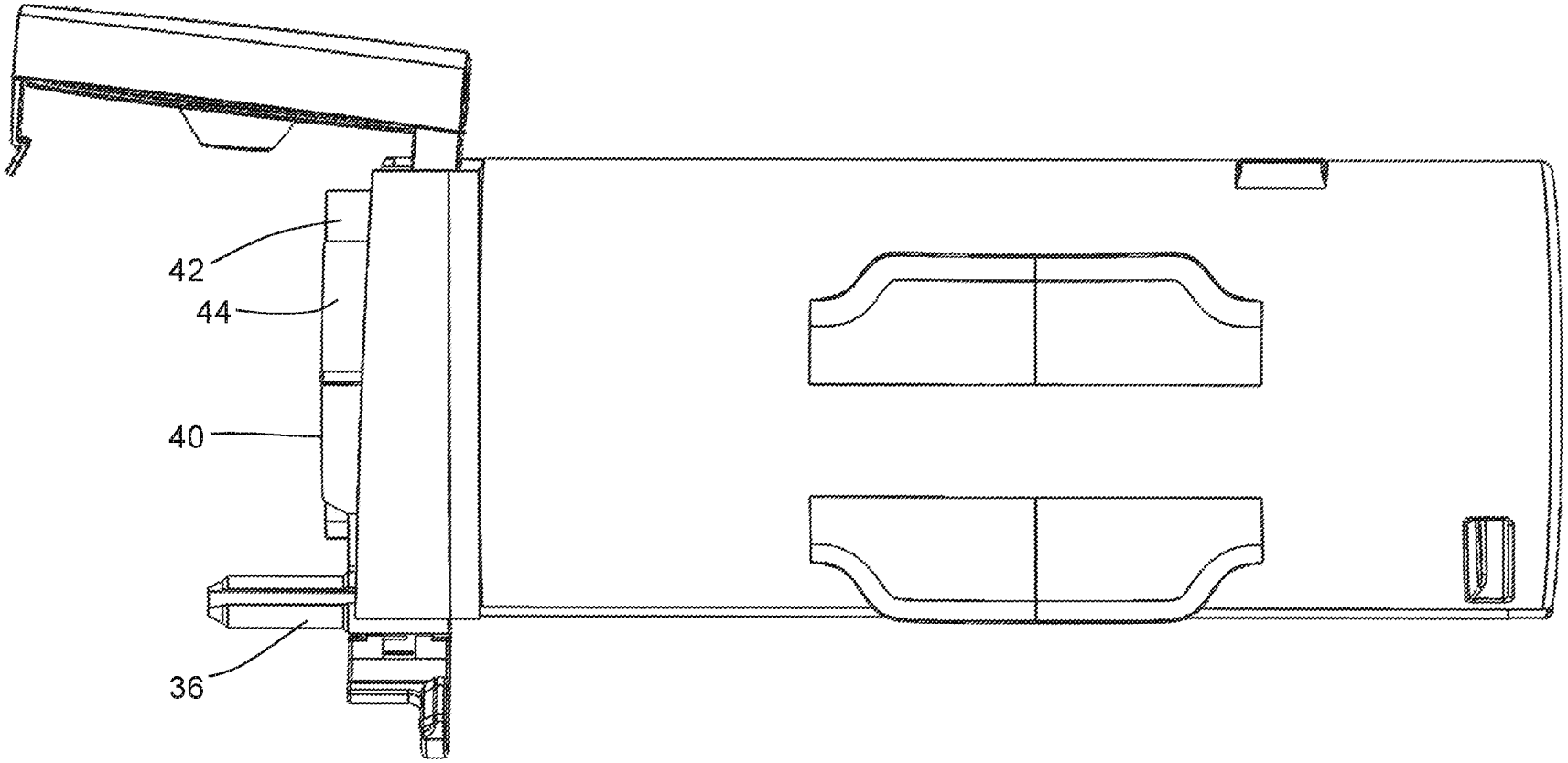
FIG. 6 shows a plan view of the dirt-collection chamber in the condition of FIG. 5.

A dirt-removal (or slide) panel 40, a part of which can be seen in FIG. 5, is connected to the slider 36, and moves with the slider as the slider moves along the rail 34. The slide panel 40 can therefore move between a first position adjacent to the first end 14 (as in FIG. 4) and a second position adjacent to the second end 14 (as in FIG. 5).

The slide panel 40 substantially spans the outer cavity 18, i.e. it fills substantially all of the gap between the shroud 30 and the wall 26 and has an opening to closely surround the baffle 24. The slide panel 40 therefore serves to push any collected dirt and debris out of the outer cavity 18 as it moves from its first position to its second position.

In this embodiment the slide panel 40 has projecting tabs 42 connected to a sleeve 44, both of which extend beyond the end of the wall 26 and shroud 30 when in the second position. This helps to ensure that all of the collected dirt and debris can be pushed out of the outer cavity 18, and thereby minimises the likelihood that some of the dirt and debris may not be emptied.

Figure 3:
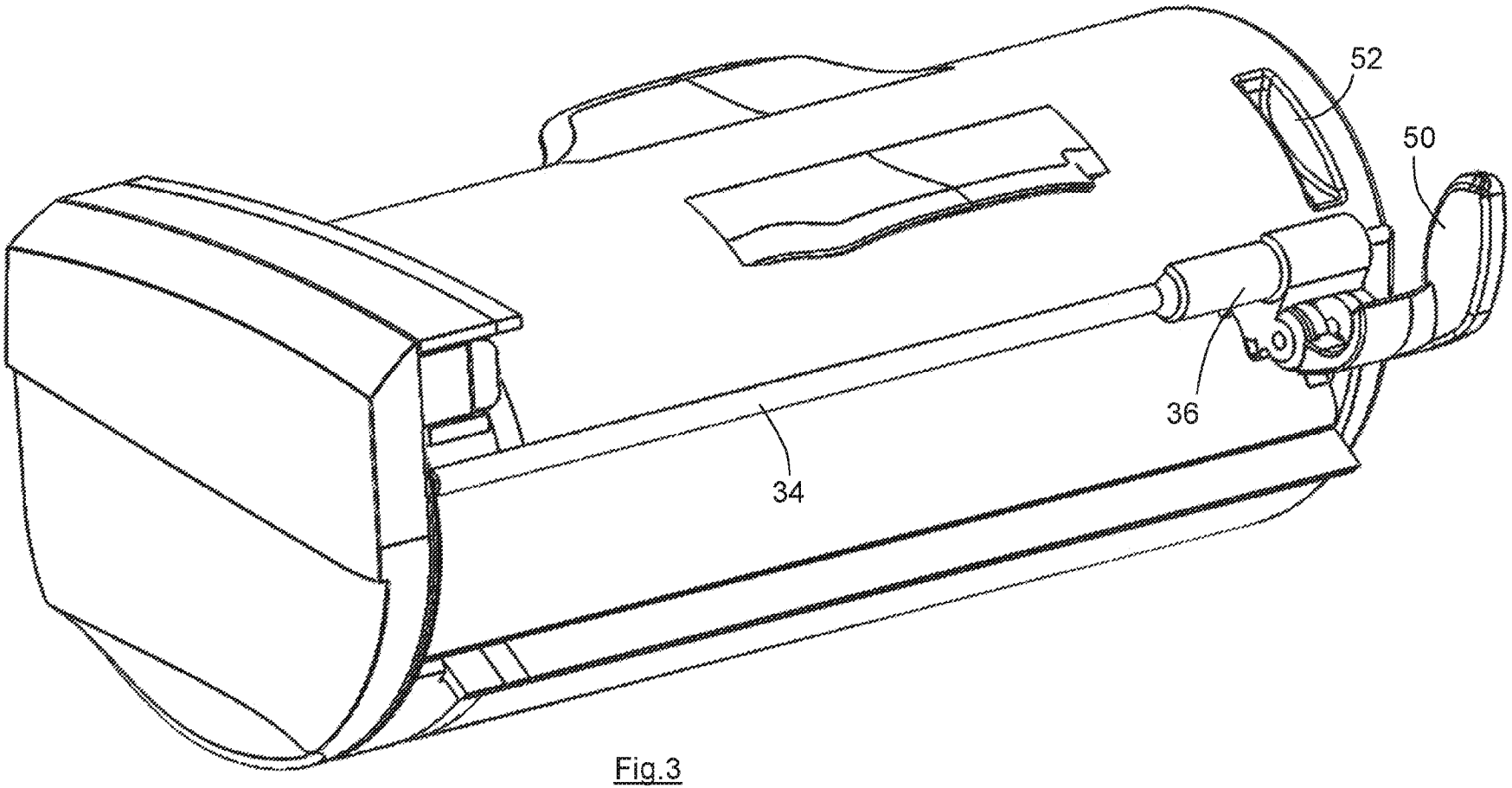
FIG. 3 shows a perspective view of the dirt-collection chamber, with the actuating handle in its actuating position.

The slider 36 also carries an actuating handle 50, the actuating handle 50 being pivotably mounted to the slider 36. The actuating handle 50 can be pivoted between a storage position as shown in FIG. 2 and an actuating position as shown in FIG. 3.

FIG. 2 shows the dirt-collection chamber 10 in the condition in which it has been removed from the suction head 2 (and similarly is ready to be re-installed in the suction head). In particular, the actuating handle 50 is in its storage position, and a proportion of the handle lies in a handle recess 52. It will be understood that the slider 36 cannot move along the rail 34 whilst the actuating handle 50 is in its storage position because of the engagement of the handle 50 with the sides of the recess 52. To move the slider 36 it is first necessary to pivot the actuating handle to its actuating position as shown in FIG. 3.

Importantly, it is arranged that the dirt-collection chamber 10 cannot be installed into the suction head 2 unless the actuating handle 50 is in its storage position. This ensures that the slide panel 40 must be fully returned to its first position adjacent to the first end 12 before the dirt-collection chamber can be fitted into its recess in the suction head 2. It is arranged that in its first position dirt and debris cannot enter behind the slide panel 40. During subsequent disposal of the collected dirt and debris therefore, none is retained in the outer cavity 18 behind the slide panel.

The first stage of the disposal procedure is to remove the dirt-collection chamber 10 from the suction head 2. In typical fashion, the dirt-collection chamber 10 may be retained in the suction head 2 by way of one or more releasable clips and the like so that the likelihood of inadvertent removal is minimised. The outer wall 26 of the dirt-collection chamber may be transparent (or substantially transparent) so as to alert the user when disposal of the collected dirt and debris is required.

Upon removal from the suction head 2 the dirt-collection chamber 10 is in the condition of FIG. 2, with the actuating handle 50 in its storage position. If the dirt-collection chamber is particularly full the user may re-orient the dirt-collection chamber 10 so that the inlet opening 22 faces upwardly during transportation to the disposal site whereby to minimise the likelihood of spillage of any of the collected dirt and debris.

When the dirt-collection chamber 10 has been carried to a disposal site (such as a household receptacle, bin or the like) the actuating handle 50 can be moved to its actuating position of FIG. 3. Also, the latch mechanism 20 can be released and the cover 16 opened over or within the receptacle. The collected dirt and debris is then forced out of the outer cavity 18 by moving the slide panel 40 from the first end 12 to the second end 14 by way of the actuating handle 50. It will be understood that it is not necessary to shake the dirt-collection chamber 10 during this procedure so that the likelihood of spillage (and in particular the likelihood of creating airborne dust) is minimised. Also, it is not necessary to re-orient the dirt-collection chamber 10 so that the disposal opening faces downwardly, although it is expected that most users will do that in order to allow the force of gravity to assist the disposal procedure. Moving the slide panel 40 to its second position as shown in FIG. 5 where it projects slightly beyond the ends of the outer wall 26 and shroud 30 will help to ensure that all of the collected dirt and debris is emptied.

In the event that dirt has collected upon or adjacent to the rail 34 this is removed as the slider 36 moves therealong, the slider 36 effectively wiping the rail clean as part of the disposal procedure. Though not clearly shown in these drawings, a part of the actuating handle 50, or a part of the slide panel 40, can also engage the bottom edge 38 of the inlet opening 22 to wipe clean that edge also.

It will be seen from FIG. 4 in particular that the inlet opening 22 continues into the disposal opening, i.e. the inlet opening 22 is open at the second end 14 of the dirt-collection chamber 10. The open-ended form of the inlet opening 22, and the ability of the slider 36 and slide panel 40 to clear dirt and debris from the longitudinal edges of the inlet opening, help to ensure that dirt and debris cannot inadvertently become trapped adjacent to the inlet opening. The inlet opening 22 is thereby cleared of dirt and debris each time the dirt-collection chamber 10 is emptied, which significantly reduces (and effectively eliminates) the likelihood that the inlet opening 22 will become blocked during use. This in turn helps to minimise the likelihood that the airflow duct within the suction head 2 will become blocked.

It will be seen that the outer wall 26 carries two fixed handles 54. It is intended that the user will grasp the handles 54 with one hand and will hold and manipulate the dirt-collection chamber 10 by way of the handles 54. The user will successively open the cover 16 and then grasp and move the actuating handle 50 with the other hand. During disposal of the collected dirt and debris, the user is therefore not required to touch the outer wall 26 adjacent to the second end 14, nor any of the internal components of the dirt-collection chamber 10. The likelihood that dirt will pass onto the user's hands is therefore minimised.

When the collected dirt and debris has been emptied, the slide panel 40 is moved back to its first position adjacent to the first end 12, and the actuating handle 50 is pivoted back to its storage position. The dirt-collection chamber 10 can be cleaned if desired, but typically the cover 16 will be closed and latched and the dirt-collection chamber 10 re-installed into the suction head 2 for further use.

Figure 7:
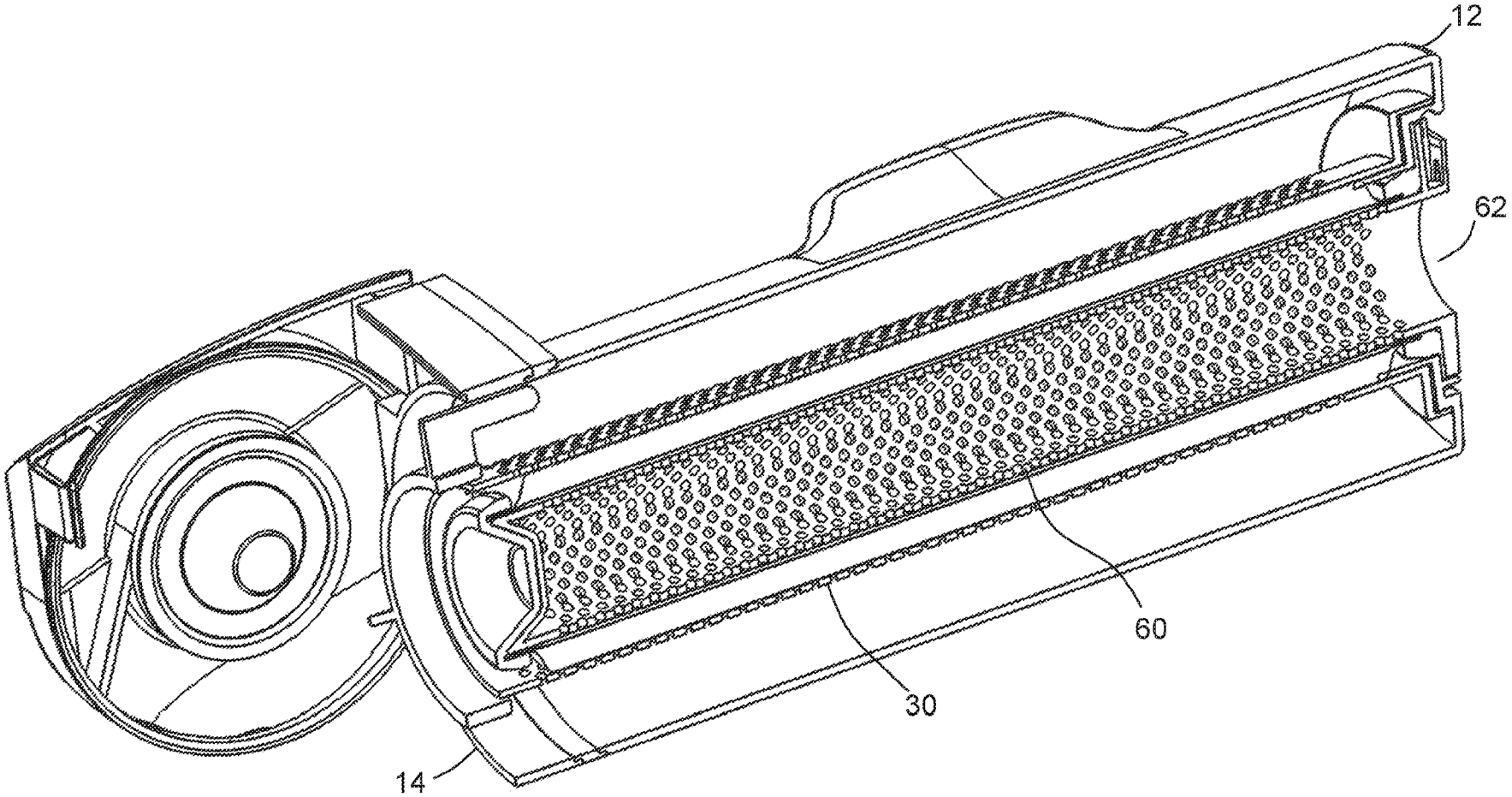
FIG. 7 shows a sectional view of the dirt-collection chamber without the dirt-removal panel.

FIG. 7 shows a cross-sectional view through the dirt-collection chamber 10, with the slide panel 40 absent. Part of the perforated shroud 30 is visible, as is part of the perforated mandrel 60 which is located inside the shroud 30. Whilst not all of the mandrel 60 is shown, it will be understood that it is desirable that the mandrel does not unduly restrict the air flow so that it is perforated around its full periphery, and along substantially its full length. It can thereby be arranged that the combined area of the holes in the mandrel 60 is significantly greater than the combined area of the holes 32 in the shroud 30.

The filter is not shown in FIG. 7, but it will be understood that the filter lies in the annulus between the shroud 30 and the mandrel 60. In particular, the filter is in the form of a flexible "sock" which can surround the mandrel. Because of the structural rigidity of the mandrel 60 the filter does not need to be self-supporting and it can be as flexible as desired.

Importantly, the end of the mandrel 60 at the second end 14 is closed or sealed and the end of the mandrel at the first end 12 is open. The outlet opening 62 is therefore located at the first end 12 of the dirt-collection chamber 10. In known fashion, the outlet opening 62 communicates with the impeller or other airflow device (not shown) of the suction head 2.

Figure 8:
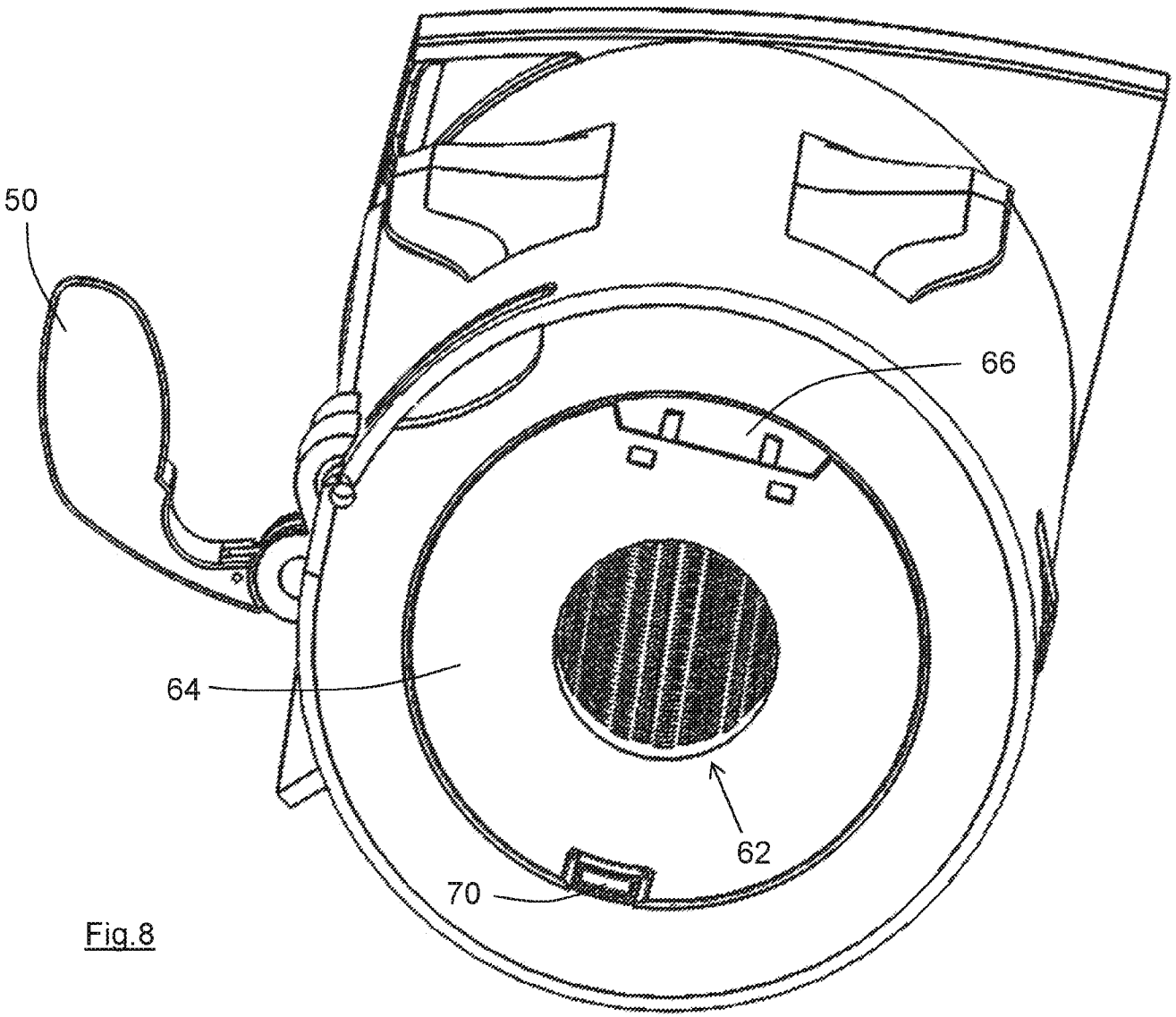
FIG. 8 shows a view of the dirt-collection chamber from the first end.

In order to facilitate periodic cleaning of the filter, the mandrel 60 and the filter carried thereby are removable from the dirt-collection chamber 10. As seen in FIG. 8. the first end 12 of the dirt-collection chamber 10 has a door 64 which can pivot about a hinge 66. The door is retained in the closed position as shown by a latch mechanism 70. When the dirt-collection chamber 10 has been removed from the suction head 2 the latch mechanism 70 can be released and the door 64 opened. The mandrel 60 and filter can then be removed together from the dirt-collection chamber and the filter can thereafter be removed from the mandrel for cleaning or replacement.

Ideally the filter is not directional, i.e. its performance is unaffected if it is inadvertently (or deliberately) turned inside out.

It is a valuable feature that the filter is removed from the first end 12, i.e. the end opposed to the disposal opening. It is expected that over time dust and dirt will collect around the disposal opening, including upon the cover 16 and around the second end of the outer wall 26, even for the most diligent of users, and it is desirable that the filter is removed from the "clean end" of the dirt-collection chamber 10. In addition, the present arrangement prevents the mandrel 60 and filter falling out of the dirt-collection chamber 10 when it is being emptied.

It will be understood that the first end 12, including the door 64, has a draft angle which enables the compression of a seal surrounding the outlet opening 62 as the dirt-collection chamber 10 is re-installed into the suction head 2.

It has been discovered that the slide panel 40 can be mounted to a single rail 34, i.e. a second rail adjacent to the bottom edge 38 of the inlet opening 22 (or elsewhere) is not required in practice. The slider 36 is mounted to the rail 34 by way of a plastic bearing having a tolerance of less than 0.5 mm. Such a small tolerance reduces the likelihood that dust particles may become trapped between the slider 36 and the rail 34 which would over time increase the force required to move the slide panel 40 and/or cause wear.

The invention claimed is:

1. A dirt-collection chamber for a vacuum cleaner, the dirt-collection chamber having an air inlet and an air outlet, the dirt-collection chamber having a filter between the air inlet and the air outlet, the dirt-collection chamber having a disposal opening with an openable cover, a dirt-removal panel in the chamber which is movable towards and away from the disposal opening, wherein the air inlet is a slot running substantially the full length of the dirt-collection chamber.

2. The dirt-collection chamber according to claim 1 in which the air inlet continues into the disposal opening.

3. The dirt-collection chamber according to claim 1 in which the dirt-collection chamber is tubular with a first end and a second end, and with the openable cover at its second end.

4. The dirt-collection chamber according to claim 3 in which the dirt-removal panel is movable between a first position adjacent to the first end and a second position adjacent to the second end.

5. The dirt-collection chamber according to claim 1 in which the dirt-removal panel is movable along the air inlet.

6. The dirt-collection chamber according to claim 1 in which the dirt-removal panel is connected to an actuating handle located outside the chamber.

7. The dirt-collection chamber according to claim 1 in which the air outlet is located at an end of the dirt-collection chamber opposed to the disposal opening.

8. The dirt-collection chamber according to claim 1 in which the filter is surrounded by a perforated wall.

9. The dirt-collection chamber according to claim 8 in which the perforations are non-uniformly arranged in the wall.

10. The dirt-collection chamber according to claim 1 in which the filter is removable through an end of the dirt-collection chamber opposed to the disposal opening.

11. The dirt-collection chamber according to claim 1 in which the filter is cylindrical and is mounted around a perforated cylindrical mandrel.

12. The dirt-collection chamber according to claim 11 in which the perforated cylindrical mandrel is connected at an end of the dirt-collection chamber opposed to the disposal opening.

13. The dirt-collection chamber according to claim 11 in which the filter is a flexible sock adapted for fitment over the perforated cylindrical mandrel.

14. The dirt-collection chamber according to claim 1 in which the dirt-collection chamber is substantially cylindrical with the filter located adjacent to the center of the cylinder.

15. The dirt-collection chamber according to claim 1 in which there is a baffle adjacent to the inlet opening.

16. The dirt-collection chamber according to claim 15 in which the baffle spans the full length of the dirt-collection chamber and is configured to cause air entering through the air inlet to flow around the chamber.

17. A dirt-collection chamber for a vacuum cleaner, the dirt-collection chamber being tubular with a first end, a second end, an air inlet and an air outlet, the dirt-collection chamber having a filter between the air inlet and the air outlet, the dirt-collection chamber having a disposal opening with an openable cover at its second end, a dirt-removal panel in the chamber, the dirt-removal panel being movable towards and away from the disposal opening between a first position adjacent to the first end and a second position adjacent to the second end, the dirt-collection chamber being adapted for fitment to a suction head of a vacuum cleaner, in which the dirt-collection chamber can only be installed into the suction head with the dirt-removal panel located in its first position.

18. A dirt-collection chamber for a vacuum cleaner, the dirt-collection chamber having an air inlet and an air outlet, the dirt-collection chamber having a filter between the air inlet and the air outlet, the dirt-collection chamber having a disposal opening with an openable cover, a dirt-removal panel in the chamber which is movable towards and away from the disposal opening, wherein the dirt-removal panel is slidably mounted upon a rail.

19. The dirt-collection chamber according to claim 18 in which the rail is located adjacent to the air inlet.

20. The dirt-collection chamber according to claim 18 in which the rail comprises a longitudinal edge of the air inlet.

21. A dirt-collection chamber for a vacuum cleaner, the dirt-collection chamber having an air inlet and an air outlet, the dirt-collection chamber having a filter between the air inlet and the air outlet, the dirt-collection chamber having a disposal opening with an openable cover, a dirt-removal panel in the chamber which is movable towards and away from the disposal opening, the air inlet having a first longitudinal edge and a second longitudinal edge, wherein the dirt-removal panel engages the first and second longitudinal edges.

22. The dirt-collection chamber according to claim 21 in which the dirt-removal panel is movable along the first and second longitudinal edges.

23. A dirt-collection chamber for a vacuum cleaner, the dirt-collection chamber having an air inlet and an air outlet, the dirt-collection chamber having a filter between the air inlet and the air outlet, the dirt-collection chamber having a disposal opening with an openable cover, a dirt-removal panel in the chamber which is movable towards and away from the disposal opening, the dirt-removal panel being connected to an actuating handle located outside the chamber, wherein the actuating handle is offset from the dirt-removal panel, and wherein the dirt-removal panel is movable to a position in which at least a part of the dirt-removal panel protrudes beyond the disposal opening.

24. A dirt-collection chamber for a vacuum cleaner, the dirt-collection chamber having an air inlet and an air outlet, the dirt-collection chamber having a cylindrical filter between the air inlet and the air outlet mounted around a perforated cylindrical mandrel, the dirt-collection chamber having a disposal opening with an openable cover, a dirt-removal panel in the chamber which is movable towards and away from the disposal opening, wherein the filter is surrounded by a perforated wall, and wherein the combined area of the perforations in the perforated cylindrical mandrel is at least as large as the combined area of the perforations in the perforated wall.

25. The dirt-collection chamber according to claim 24 in which the dirt-collection chamber is substantially cylindrical with the filter located adjacent to the center of the cylinder.

26. A suction head for a vacuum cleaner, the suction head having a dirt-collection chamber with an air inlet, an air outlet and a filter between the air inlet and the air outlet, the dirt-collection chamber having a disposal opening with an openable cover, a dirt-removal panel in the chamber which is movable towards and away from the disposal opening, the suction head having an opening in its bottom surface and a rotatable brush located at the opening, the distance between the periphery of the rotatable brush and the air inlet at the nearest point being between one third and one half of the diameter of the rotatable brush.

27. A suction head for a vacuum cleaner, the suction head having a dirt-collection chamber with an air inlet, an air outlet and a filter between the air inlet and the air outlet, the dirt-collection chamber having a disposal opening with an openable cover, a dirt-removal panel in the chamber which is movable towards and away from the disposal opening, the suction head having an opening in its bottom surface and a rotatable brush located at the opening, the distance between the opening and the air inlet at the nearest point being less than the diameter of the rotatable brush.

* * * * *